US009840783B2

(12) United States Patent
Thiele et al.

(10) Patent No.: US 9,840,783 B2
(45) Date of Patent: Dec. 12, 2017

(54) METHOD FOR PRODUCING PEROXODISULFATES IN AQUEOUS SOLUTION

(71) Applicant: Degussa Initiators GmbH & Co. KG, Pullach (DE)

(72) Inventors: Wolfgang Thiele, Eilenburg (DE); Hans-Jürgen Kramer, Dessau (DE); Hans-Jürgen Förster, Bitterfeld (DE)

(73) Assignee: Degussa Initiators GmbH & Co. KG, Pullach (DE)

( * ) Notice: Subject to any disclaimer, the term of this patent is extended or adjusted under 35 U.S.C. 154(b) by 0 days.

(21) Appl. No.: 15/062,836

(22) Filed: Mar. 7, 2016

(65) Prior Publication Data

US 2016/0186338 A1 Jun. 30, 2016

Related U.S. Application Data

(63) Continuation of application No. 13/027,672, filed on Feb. 15, 2011, now abandoned, which is a continuation of application No. 11/569,464, filed as application No. PCT/EP2005/006008 on Jun. 3, 2005, now abandoned.

(30) Foreign Application Priority Data

Jun. 5, 2004 (DE) ..... 10 2004 027 623

(51) Int. Cl.

| | |
|---|---|
| ***C02F 1/46*** | (2006.01) |
| ***C25B 11/04*** | (2006.01) |
| ***C25B 1/28*** | (2006.01) |
| ***C25B 9/06*** | (2006.01) |
| ***C25B 9/20*** | (2006.01) |
| ***C25B 1/22*** | (2006.01) |
| ***C25B 1/30*** | (2006.01) |

(52) U.S. Cl.
CPC ..... *C25B 11/0447* (2013.01); *C25B 1/22* (2013.01); *C25B 1/285* (2013.01); *C25B 1/30* (2013.01); *C25B 9/063* (2013.01); *C25B 9/203* (2013.01); *C25B 11/0405* (2013.01); *C25B 11/0421* (2013.01)

(58) Field of Classification Search
CPC ... C25B 11/0447; C25B 1/22; C25B 11/0421; C25B 11/0405; C25B 1/30
See application file for complete search history.

(56) References Cited

U.S. PATENT DOCUMENTS

| | | | | |
|---|---|---|---|---|
| 3,926,770 | A | 12/1975 | Hoekje | |
| 6,306,270 | B1 | 10/2001 | Haenni et al. | |
| 6,503,386 | B2 | 1/2003 | Lehmann et al. | |
| 6,533,916 | B1 * | 3/2003 | Puetter ..... | C02F 1/46109 204/290.01 |
| 6,855,242 | B1 | 2/2005 | Comninellis et al. | |
| 7,335,284 | B2 | 2/2008 | Haenni et al. | |

FOREIGN PATENT DOCUMENTS

| | | | |
|---|---|---|---|
| DE | 200 05 681 | U1 | 6/2000 |
| DE | 199 11 746 | A1 | 9/2000 |
| DE | 199 48 184 | A1 | 5/2001 |
| DE | 100 15 209 | A1 | 10/2001 |
| DE | 100 19 683 | A1 | 10/2001 |
| EP | 1 254 972 | A1 | 11/2002 |
| FR | 2 790 268 | A1 | 9/2000 |

* cited by examiner

*Primary Examiner* — Arun S Phasge
(74) *Attorney, Agent, or Firm* — Norton Rose Fulbright US LLP

(57) ABSTRACT

A process for preparing or regenerating peroxodisulfuric acid and its salts by electrolysis of an aqueous solution containing sulfuric acid and/or metal sulfates at diamond-coated electrodes without addition of promoters is described, with bipolar silicon electrodes which are coated with diamond on one side and whose uncoated silicon rear side serves as cathode being used.

16 Claims, No Drawings

METHOD FOR PRODUCING PEROXODISULFATES IN AQUEOUS SOLUTION

This application is a continuation of U.S. patent application Ser. No. 13/027,672, filed Feb. 15, 2011, pending, which is a continuation of U.S. patent application Ser. No. 11/569,464, filed Nov. 30, 2006, abandoned, which is a §371 of International Application No. PCT/EP2005/006008 filed Jun. 3, 2005, and claims priority from German Patent Application No. 10 2004 027 623.4 filed Jun. 5, 2004, each of which is incorporated herein by reference in its entirety for all purposes.

The invention relates to a process for preparing or regenerating peroxodisulfuric acid and its salts by electrolysis of an aqueous solution containing sulfuric acid and/or metal sulfates. As used herein, the term "metal sulfates" encompasses both sulfates of metals such as zinc, nickel or iron and sulfates of alkali metals and alkaline earth metals and also ammonium sulfate. Thus, it is possible to use, for example, alkali metal sulfates or alkaline earth metal sulfates, preferably alkali metal sulfates or ammonium sulfate, as metal sulfates. It is also possible to use mixtures of various metal sulfates, for example magnesium sulfate, zinc sulfate or else nickel or iron sulfate, preferably in the regeneration of etching and pickling solutions.

It is known from the prior art that diamond-coated electrodes composed of valve metals, preferably niobium, or ceramic materials, preferably silicon, can be used for the preparation of peroxodisulfates of the alkali metals and of ammonium [DE 199 48 184.9, DE 100 19 683], The diamond layer is made conductive by doping with a trivalent or pentavalent element, preferably boron. These have advantages over the smooth platinum anodes which have hitherto been exclusively used in peroxodisulfate production in that, as a result of the high potential which can be achieved on the diamond surface, it is not necessary to add potential-increasing additives to the electrolyte in order to achieve sufficiently high current yields, as is unavoidable in the case of platinum anodes. The preferred use of thiocyanates as polarizers results in anode gases which contain cyanide and make complicated gas purification measures necessary. When diamond-coated anodes are used, these can be dispensed with.

A further advantage of diamond-coated anodes in peroxodisulfate production is that, even at a low sulfate content in the anolyte, significantly higher current yields can be achieved than when using platinum anodes.

However, despite the good stability of, in particular, diamond-coated silicon electrodes, their use is associated with a number of disadvantages, Thus, there is the problem of suitable supply of electric current. Owing to the relatively low electrical conductivity of the silicon base body, a contact has to be provided over the entire area of the reverse side of the electrode, so that current needs to flow only from the contacted rear side through the small thickness of the silicon electrode of about 1-2 mm to the diamond coating. Although this problem could in principle be solved by adhesive bonding of the preferably metallized rear sides of the silicon plates to a metallic substrate having a good conductivity by means of an electrically conductive adhesive, this is relatively complicated.

A further disadvantage of the diamond-coated silicon electrodes of the prior art is their limited dimensions of at present not more than 200×250 mm. In order to nevertheless be able to provide large-area anodes for use in industrial electrolysis cells, EP 1 229 149 proposed adhesively bonding a relatively large number of such silicon-diamond electrodes by means of an electrically conductive adhesive to a metal base plate, e.g. composed of a valve metal, and sealing the edges by means of a corrosion-resistant resin, e.g. epoxy resin. However, the difficulties involved, for example in the provision of the conductive adhesive, e.g. an adhesive composed of epoxy resin containing silver particles, and in the complete elimination of the oxide layers on the areas to be joined, are very great. In addition, such an electrode construction has been found to be insufficiently corrosion resistant for the preparation of peroxodisulfate, so that only short operation lives of usually less than one year can be achieved in this way.

Another possible way disclosed in the prior art for constructing electrolysis cells having a sufficiently large current capacity is to connect a relatively large number of bipolar silicon-diamond electrodes in series. FR 2790268 B1 discloses such a bipolar electrolysis cell in which the bipolar electrodes comprise a ceramic substrate which is completely enveloped by a diamond film. However, this cell is not proposed specifically for the preparation of peroxodisulfates but for uses in the degradation of pollutants or for disinfection of water.

DE 200 05 681 describes the use of bipolar electrodes coated on both sides with diamond layers.

EP 1 254 972 proposes an electrolysis cell construction which is suitable for various applications and can be configured as a monopolar or bipolar, undivided or divided cell. In the bipolar design, silicon disk electrodes coated on both sides with a diamond layer are once again exclusively used. In the preparation of peroxodisulfates, these cells having silicon electrodes coated on both sides with a diamond layer and the relatively complicated cell construction can be used effectively only for small persulfate throughputs. If an attempt is made to increase the throughput to industrially relevant ranges by means of a relatively large number of individual bipolar cells, this construction results in reduced yields due to the loss currents in the power supply leads and power outlet leads which increase greatly with the total voltage.

It was therefore an object of the present invention to provide a process for preparing or regenerating peroxodisulfuric acid and/or its salts, in which the above-described disadvantages of previous processes and electrolysis cells are at least partly avoided. It has been found that peroxodisulfates can advantageously be prepared in undivided or divided electrolysis cells in a simple manner by using bipolar silicon electrodes which have been coated on one side with doped diamond, with the uncoated silicon rear sides acting directly as cathodes.

According to the invention, the coating on the silicon electrode has a thickness of from about 1 to about 20 μm, preferably about 5 μm.

It was highly surprising that only the coating on the anode side of the bipolar electrode is necessary in order to achieve satisfactory results with the uncoated silicon rear side which then functions as cathode. In the case of an undivided bipolar cell, it was also surprisingly found that lower persulfate losses occur as a result of cathodic reduction when using a silicon cathode according to the invention compared to the metal cathodes which are usually used in the prior art in persulfate production.

Furthermore, it has been found that it is not only possible to achieve high persulfate formation rates when using the bipolar electrodes according to the invention but this can be achieved even at very low cell voltages and thus low specific electric energy consumptions. This is based firstly on the recognition that the silicon cathode surfaces are freed of the poorly conductive oxide layers which are initially present by means of the cathodic reaction and are also kept completely free during the course of the electrolysis. For example, it was found in a long-term experiment (cf. example 1) that the cell voltage is even reduced further with increasing time of operation, while in the case of the diamond-coated silicon electrodes adhesively bonded to a metal substrate according to the prior art, an opposite tendency is observed as a result of increasing corrosion.

The process of the invention thus advantageously makes it possible to prepare peroxodisulfuric acid and/or its salts at a genuine bipolar electrode with a high current yield and a low electric energy consumption even though only the slightly conductive silicon is used as cathode. In addition, no costs for a cathode coating are incurred.

A further advantage of the inventive bipolar silicon electrodes coated on one side with diamond is the lower catalytic activity of the silicon rear side compared to a metallized electrode rear side, e.g. composed of platinum or stainless steel. It has been found that reduction losses of peroxodisulfate are therefore lower when electrolysis is carried out in an undivided electrolysis cell. This leads, in the case of undivided cells, to the increase in the peroxodisulfate concentration with electrolysis time being somewhat steeper and the achievable final concentration being higher than when a metallized cathode is used under otherwise identical electrolysis conditions.

Compared to the bipolar electrodes of the prior art which are coated with doped diamond on both sides, cost savings are advantageously achieved both for the electrodes themselves and for the electrolysis cells equipped therewith and also as a result of the lower electric energy consumptions which can be achieved.

The process of the invention for preparing peroxodisulfuric acid and/or its salts can be carried out both in undivided electrolysis cells and in electrolysis cells which are divided, for example by means of ion-exchange membranes or porous diaphragms.

The bipolar silicon electrodes according to the invention which are coated on one side with diamond are particularly useful for undivided electrolysis cells having a relatively simple construction, as are described, for example, in DE G 200 05 681.6 for the disinfection of water. It is advantageous in terms of the current input for the monopolar boundary anodes to comprise a diamond-coated valve metal. The term "valve metal" refers to a metal which when connected as an anode becomes coated with an oxide layer which becomes nonconductive even at high voltages. Connected as anode, the metal blocks. Connected as cathode, the oxide layer is dissolved and current flows in a fairly uninhibited fashion. Thus, valve metals behave like a rectifier when different polarities are applied. Examples of suitable valve metals are tantalum, titanium, niobium and zirconium. For the purposes of the present invention, preference is given to using niobium.

The monopolar boundary cathodes preferably comprise a suitable material having a good conductivity, e.g. stainless steel, Hastelloy, platinum and impregnated graphite. For the purposes of the present invention, preference is given to using high-alloy stainless steels or Hastelloy. A silicon boundary cathode having a metallized rear side and with a current supply plate composed of a material having a good conductivity, e.g. copper, as contact can also be used due to the good long-term stability in undivided cells. Particularly when using boundary electrodes composed of metallic materials, optimal current input can be achieved in a simple manner and without large voltage drops because of the good conductivity.

It is also possible for a plurality of electrode stacks comprising bipolar electrodes and boundary electrodes with power supply lead to be connected electrically in parallel in an electrolysis cell. If necessary, the spacing between the bipolar electrodes can be set or fixed by means of spacers. Such electrode stacks connected in parallel make it possible to accommodate relatively large power capacities in an electrolysis cell without an unjustifiably high total voltage being necessary. The voltage can thus also be optimally matched to the available rectifier voltage. In addition, the short circuit currents in the common feed and discharge lines for the electrolyte solutions can be minimized further as a result, which can additionally be aided in a known manner by installation of additional resistance sections in these lines.

Undivided bipolar cells having the structure provided by the invention can be used particularly advantageously when the peroxodisulfate concentration does not have to be very high for the application in question, for example for the oxidative degradation of pollutants in process solutions and wastewater. As can be seen from example 2, sodium peroxodisulfate reaction solutions having a content of from 50 to 100 g/l can be prepared very effectively in batch operation in an undivided cell provided with the bipolar electrodes according to the invention at current yields of from 75 to 50% and specific electric energy consumptions of from 1.3 to 1.9 kWh/kg.

Even better current yields or the same yields at higher final peroxodisulfate concentrations can be achieved by shielding of the cathode by means of suitable materials which inhibit mass transfer to the cathode surface, as can be seen from example 3. Materials suitable for these purposes are, for example, PVC gauzes. The process of the invention thus makes it possible to obtain sodium peroxodisulfate concentrations from 150 to 200 g/l with justifiable current yields of about 50% in undivided cells, albeit at relatively high cell voltages.

If higher final concentrations of peroxodisulfates, e.g. in the range from 200 to 400 g/l of sodium peroxodisulfate, are desired, the use of divided electrolysis cells provided with the bipolar silicon electrodes according to the invention is preferred. As can be seen from example 4, current yields of from about 75 to 85% can be achieved in this way, albeit with a more complicated cell construction and higher cell voltages of from about 5.5 to 6 V. However, comparatively very good specific electric energy consumptions of less than 2.0 kWh/kg can still be achieved in this way.

A further surprising effect of the process of the invention are the very low corrosion rates at the silicon cathodes which are found in undivided electrolysis cells in a long-term experiment using an acidic persulfate-containing electrolyte. Thus, surprisingly low corrosion rates of only 2-3 μm were found in an undivided cell at a steady-state sodium peroxodisulfate content of about 150 g/l in a long-term experiment over about 7 months (cf. example 1). This was particularly surprising because 10-100 times greater corrosion was observed even on platinum cathodes of the prior art under these very highly corrosive conditions. Even cathodes made of graphite or high-alloy stainless steels were found to be unsuitable in such peroxodisulfate-containing sulfuric acid electrolyte solutions because they were insufficiently corrosion-resistant.

EXAMPLES

Example 1

An undivided bipolar electrolysis cell having a construction analogous to that in DE G 200 05 681.6 contained 9 bipolar silicon electrodes coated on one side with about 3 μm of boron-doped diamond (average about 3000 ppm of boron). A niobium electrode coated on one side with diamond and provided with a power supply lead served as boundary anode. The boundary cathode with power supply lead comprised Hastelloy. The bipolar electrodes had a dimension of 100×33 mm (33 $cm^2$). The mean spacing of the about 1 mm thick bipolar electrodes was set to about 2 mm by means of spacers. The electrolysis current was regulated at a constant 16.5 A, corresponding to an anodic and cathodic current density of 6.5 $A/cm^2$. The total current capacity of the electrolysis cell was thus 10×16.5=165 A. 2 l of an aqueous solution containing 300 g/l of sodium sulfate and 200 g/l of sulfuric acid served as electrolyte. It was circulated at a rate of about 600 l/h from a circulation reservoir via a heat exchanger and through the cell by pumping (batch operation). Electrolysis operation was maintained for 5000 hours, with only the water which had evaporated or been decomposed being replaced. In steady-state operation, a concentration of 170-190 g/l of sodium peroxodisulfate was established at a steady-state temperature of about 35° C. The total voltage on start-up was 50 V. The mean cell voltage changed as follows over the course of continuous operation:

| Operating time of | 5 h | 50 h | 500 h | 5000 h |
|---|---|---|---|---|
| Mean cell voltage | 4.95 V | 4.60 V | 4.35 V | 4.18 V |

After 5000 hours of operation, the electrodes were removed and the weight loss was determined. The mean decrease in the silicon electrode thickness was calculated therefrom as an average of 3 μm. The thickness of the silicon cathode thus decreases by only about 10 μm per year.

Example 2

The dependence of the current yield on the final concentration of sodium peroxodisulfate (NaPS) achieved was determined by means of the undivided electrolysis cell from example 1 under the same electrolysis conditions (current density, temperature, batch operation, electrolyte composition). The following results were obtained:

| Final concentration of NaPS in g/l | 25 | 50 | 75 | 100 | 125 | 150 |
|---|---|---|---|---|---|---|
| Current yield of NaPS formation in % | 84 | 77 | 64 | 50 | 40 | 34 |

At the favorable cell voltage of about 4.2 V established after a prolonged period of operation, the specific electric energy consumption was 1.23 kWh/kg for a final concentration of 50 g/l; for a final concentration of 100 g/l of NaPS, it was still 1.89 kWh/kg despite the fact that the current yield had dropped to 50%.

Example 3

The same undivided electrolysis cell as in examples 1 and 2 was equipped with a PVC gauze resting on the cathodes of the bipolar electrode plates and the boundary cathode; this gauze could be pressed onto the surface by means of a plastic spacer. Electrolysis was again carried out under the same electrolysis conditions as in example 2. The following current yields, based on the final NaPS concentration achieved, were obtained.

| Final concentration of NaPS in g/l | 50 | 75 | 100 | 125 | 150 | 175 | 200 |
|---|---|---|---|---|---|---|---|
| Current yield of NaPS formation in % | 84 | 77 | 73 | 68 | 61 | 54 | 49 |

Even in the concentration range from 100 to 200 g/l, relatively favorable current yields were obtained and these were an average of about 20% higher than without shielding of the cathode surfaces. However, the cell voltages were about 0.8 V higher due to the additional resistance of the gauze shielding. Nevertheless, a very favorable specific electric energy consumption of about 1.85 kWh/kg was still obtained at, for example, a final NaPS concentration of 150 g/l.

Example 4

The nine bipolar electrodes and the two monopolar boundary electrodes of the undivided electrolysis cell used in examples 1 to 3 were used in a divided bipolar cell. Cation-exchange membranes which were fixed on both sides by means of anode and cathode spacers made of plastic were used for separating anolyte and catholyte. The anode and cathode spaces bounded by sealing frames had a thickness of 2-3 mm each. Anolyte and catholyte were circulated in separate circuits through a heat exchanger. 500 g/l of sulfuric acid served as catholyte. The anolyte once again consisted of an aqueous solution containing 200 g/l of sulfuric acid and 300 g/l of sodium sulfate. To avoid an excessively large decrease in the sodium sulfate concentration due to both consumption to form peroxodisulfate and the transport of $Na^+$ ions through the cation-exchange membrane into the catholyte at the desired high final. NaPS concentrations, a further 100 g/l of sodium sulfate were dissolved in the anolyte during the electrolysis (i.e. a total of 400 g/l of sodium sulfate). The anodic and cathodic current densities were each set to 0.5 $A/cm^2$.

Under otherwise comparable electrolysis conditions, the following current yields were obtained for various final NaPS concentrations:

at a final NaPS concentration of 200 g/l, a current yield of 86% at a final NaPS concentration of 300 g/l, a current yield of 82% at a final NaPS concentration of 400 g/l, a current yield of 74%

The mean cell voltages were in the range from 5.5 to 6 V. At the final concentration of 400 g/l, a still very low specific electric energy consumption of about 1.8 kWh/kg could thus be achieved.

The invention claimed is:

1. A process for preparing peroxodisulfuric acid or a salt thereof comprising the step of performing electrolysis of an aqueous solution of at least one of sulfuric acid or a metal sulfate at diamond-coated electrodes without addition of a promoter, wherein each of the diamond-coated electrodes are bipolar silicon electrodes which are coated only on one side with doped diamond and have an uncoated silicon rear side which serves as a cathode, wherein the process is conducted in an acidic, persulfate containing electrolyte, wherein the peroxodisulfuric acid or salt thereof is prepared in an amount of at least 50 g/L.

2. The process of claim 1, wherein the electrolysis is carried out in undivided electrolysis cells.

3. The process of claim 2, wherein a diamond-coated anode composed of a valve metal and provided with a power supply lead is used as a boundary anode.

4. The process of claim 3, wherein the valve metal is niobium.

5. The process of claim 2, wherein stainless steel, Hastelloy, platinum, impregnated graphite or silicon which has been metallized on one side is used for the boundary cathode provided with a power supply lead.

6. The process of claim 1, wherein the electrolysis is carried out in electrolysis cells which are divided by at least one of an ion-exchange membrane or a porous diaphragm.

7. The process of claim 6, wherein a diamond-coated anode composed of a valve metal and provided with a power supply lead is used as a boundary anode.

8. The process of claim 7, wherein the valve metal is niobium.

9. The process of claim 6, wherein stainless steel, Hastelloy, platinum, impregnated graphite or silicon which has been metallized on one side is used for the boundary cathode provided with a power supply lead.

10. The process of claim 1, wherein a diamond-coated anode composed of a valve metal and provided with a power supply lead is used as a boundary anode.

11. The process of claim 10, wherein the valve metal is niobium.

12. The process of claim 1, wherein stainless steel, Hastelloy, platinum, impregnated graphite or silicon which has been metallized on one side is used for the boundary cathode provided with a power supply lead.

13. The process of claim 1, wherein a plurality of electrode stacks comprising bipolar electrodes and boundary electrodes with power supply lead are connected electrically in parallel within an electrolysis cell.

14. The process of claim 1, wherein the wherein the peroxodisulfuric acid or salt thereof is prepared in an amount of from 50 g/L to 100 g/L.

15. The process of claim 1, wherein the wherein the peroxodisulfuric acid or salt thereof is prepared in an amount of from 200 g/L to 400 g/L.

16. The process of claim 1, wherein the wherein the peroxodisulfuric acid or salt thereof is prepared in an amount of from 150 g/L.

* * * * *